US008942614B2

(12) United States Patent
Nishihiro

(10) Patent No.: US 8,942,614 B2
(45) Date of Patent: Jan. 27, 2015

(54) FILM CARTRIDGE HAVING FIRST ROLLER CONFIGURED SO FILM CAN BE WOUND THEREON AND SECOND ROLLER CONFIGURED TO WIND UP THE FILM AND GLOSS PROCESSING APPARATUS HAVING SUCH FILM CARTRIDGE

(75) Inventor: Shingo Nishihiro, Inzai (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 13/489,758

(22) Filed: Jun. 6, 2012

(65) Prior Publication Data

US 2012/0312909 A1 Dec. 13, 2012

(30) Foreign Application Priority Data

Jun. 7, 2011 (JP) ..... 2011-127091

(51) Int. Cl.
*G03G 15/20* (2006.01)
*G03G 15/00* (2006.01)

(52) U.S. Cl.
CPC .. *G03G 15/6585* (2013.01); *G03G 2215/00805* (2013.01)
USPC ..... 399/341

(58) Field of Classification Search
USPC ..... 399/341, 342, 329; 242/347.2
See application file for complete search history.

(56) References Cited

U.S. PATENT DOCUMENTS

| | | | | | |
|---|---|---|---|---|---|
| 3,482,681 | A * | 12/1969 | Nerwin et al. | ..... | 206/410 |
| 3,701,495 | A * | 10/1972 | Holliday | ..... | 242/348 |
| 4,469,292 | A * | 9/1984 | Mangold | ..... | 242/336 |
| 5,262,834 | A * | 11/1993 | Kusaka et al. | ..... | 399/329 |
| 7,783,242 | B2 | 8/2010 | Chigono et al. | | |
| 2007/0147917 | A1 | 6/2007 | Chigono et al. | | |
| 2012/0003346 | A1 * | 1/2012 | Chigono et al. | ..... | 425/363 |

FOREIGN PATENT DOCUMENTS

JP 2007-86747 A 4/2007

* cited by examiner

*Primary Examiner* — Billy Lactaoen
(74) *Attorney, Agent, or Firm* — Fitzpatrick, Cella, Harper & Scinto

(57) ABSTRACT

A cartridge detachably mountable to a heating apparatus includes: a film; a supporting member for unwindably supporting the film; a winding-up member for winding up the film; a first container accommodating the supporting member and having a first opening; and a second container accommodating the winding-up member and having a second opening. The film is unwindable from the supporting member to the winding-up member through the first opening and the second opening. The first container and the second container are connected with each other so that the first container and the second container cover at least one side of the film, and the first container and the second container are disconnectable from each other to expose the film between the first opening and the second opening.

14 Claims, 10 Drawing Sheets

FILM CARTRIDGE HAVING FIRST ROLLER CONFIGURED SO FILM CAN BE WOUND THEREON AND SECOND ROLLER CONFIGURED TO WIND UP THE FILM AND GLOSS PROCESSING APPARATUS HAVING SUCH FILM CARTRIDGE

FIELD OF THE INVENTION AND RELATED ART

The present invention relates to a film cartridge which is removably installable in a heating apparatus which heats recording medium through film. It relates to also a heating apparatus which uses a film cartridge.

In recent years, it has come to be desired to output a print with a specific visual effect by partially or entirely altering a print in gloss. For example, it has come to be desired to output a print which looks like a silver-salt photograph, by increasing in gloss the entire surface of the print. One of the apparatuses capable of achieving such an objective is disclosed in Japanese Laid-open Patent Application 2007-86747. According to this patent application, the apparatus is provided with a heating belt, and is structured to uniformly heat the entire surface of a print (image) through the belt in order to uniformly increase the print (image) in gloss, so that it can output a print which looks like a silver-salt photograph.

It has also been desired to increase a part or parts of a print (image) in gloss in order to give the print (image) a visual effect attributable to the difference in glossiness between the part or parts of the print which are higher in gloss, and their adjacencies. The part or parts having such a visual effect are called watermarks, security marks, etc.

It is difficult to give a print a visual effect such as the one described above with the use of a heating apparatus, such as the one disclosed in Japanese Laid-open Patent Application 2007-86747, which is structured to heat the entire surface of a print (image) with the use of a belt. That is, in the case of a heating apparatus structured as disclosed in Japanese Laid-open Patent Application 2007-86747, the entirety of a print (image) is heated. Therefore, it is difficult to increase in gloss only a part or parts of the print (image), with the use of a heating apparatus such as the one disclosed in Japanese Laid-open Patent Application 2007-86747.

Thus, in order to achieve the above described visual effect which can not be achieved by any of the conventional heating apparatuses, the inventors of the present invention came up with an idea to heat a part or parts of a print (image) with the use of a thermal head (heating means) through a sheet of film which is smaller in thermal resistance than the aforementioned belt. However, film which is low in thermal capacity is liable to deform as it is heated. Therefore, the film had to be frequently replaced.

It is possible to use a role of film which can be easily replaced in entirety. However, the mechanism for suspending and keeping stretched the extended portion of a role of film is complicated. Further, as foreign substances such as dust adhere to the film and/or thermal head, the portions of the film having the foreign substances increases in thermal resistance, which may cause the heating apparatus to fail to properly heat a print (image).

As one of the solutions to the above described problems, it is possible to place a role of film and a thermal head in a cartridge which has a container for an unused role of film and a container for a take-up roller for taking up the used portion of film, and which is structured so that the thermal head is positioned between the container for an unused role of film and container for a take-up roller. However, this structural arrangement requires that as the cartridge in a heating apparatus is replaced to replace the used role of film therein, the thermal head is replaced along with the used role of film. Therefore, it increases a heating apparatus in cost. Further, placing a thermal head in a film cartridge increases the cartridge in size.

SUMMARY OF THE INVENTION

In consideration of the above-described issues, the primary object of the present invention is to provide an inexpensive film cartridge for a heating apparatus, which is structured so that it is removably installable in a heating apparatus and can minimize the amount by which foreign substances adhere to the film.

According to an aspect of the present invention, there is provided a cartridge detachably mountable to a heating apparatus, said cartridge comprising a film; a supporting member for unwindably supporting said film; a winding-up member for winding up said film; a first container accommodating said supporting member and having a first opening; and a second container accommodating said winding-up member and having a second opening, wherein said film is unwindable from said supporting member to said wing-up member through said first opening and said second opening, wherein said first container and said second container are connected with each other so that said first container and said second container cover at least one side of said film, and wherein said first container and said second container are disconnectable from each other to expose said film between said first opening and said second opening.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Figure 1:
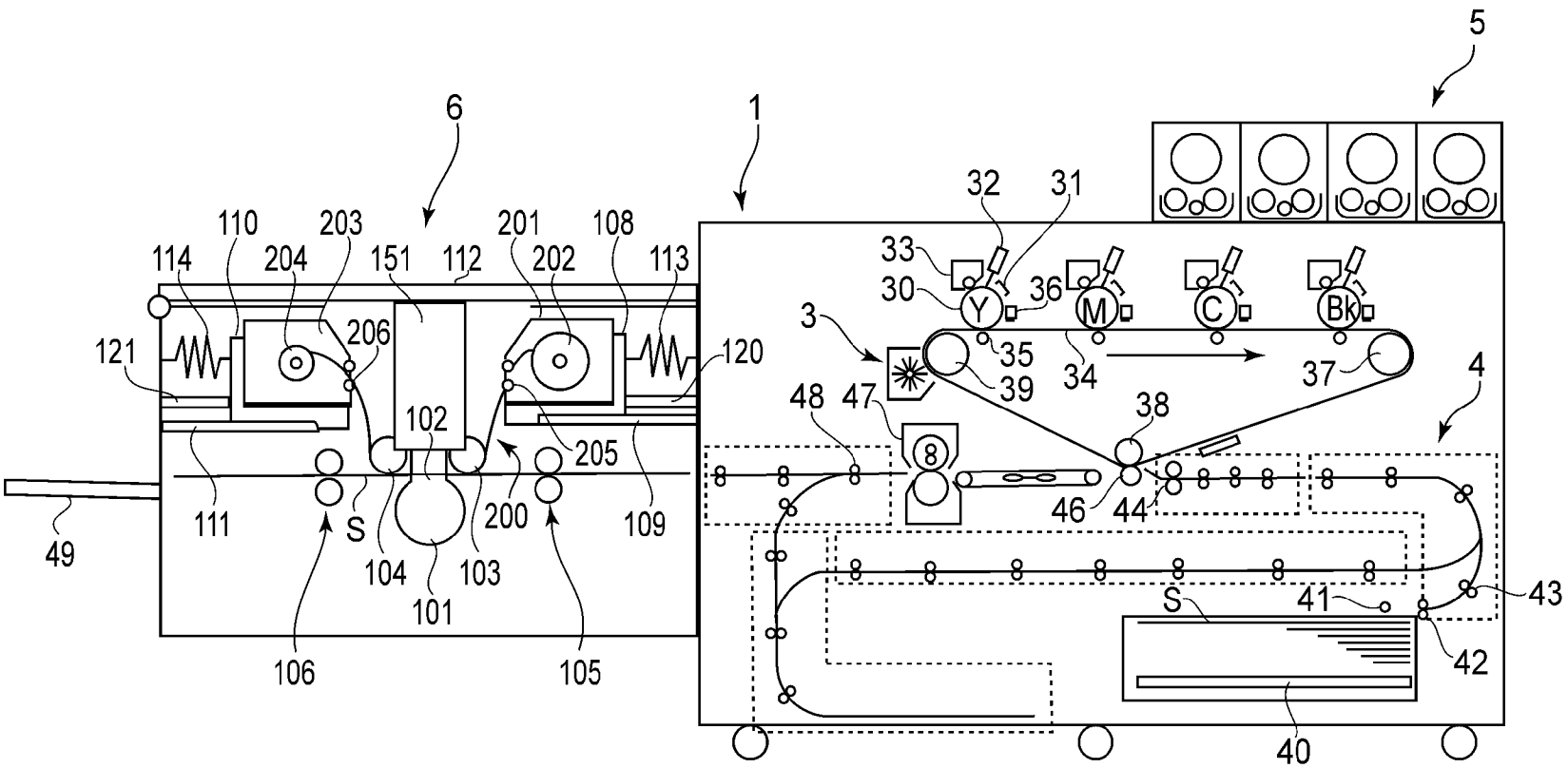
FIG. 1 is a schematic sectional view of an image forming apparatus equipped with a gloss altering apparatus, that is, a heating apparatus, in the first embodiment of the present invention, and shows the general structure of the apparatus.

Referring to FIGS. 1-12, the first embodiment of the present invention is described. First, referring to FIG. 1, the image forming apparatus equipped with a gloss altering apparatus, which is a heating apparatus, is described about its general structure.

[General Structure of Image Forming Apparatus]

The main assembly 1 of the image forming apparatus has an image forming section 3 and a recording medium conveying section 4, which are in the top and bottom portions, respectively, of the main assembly 1. The image formation section 3 has Y (yellow), M (magenta), C (cyan) and Bk (black) stations, which form yellow, magenta, cyan, and black monochromatic images, respectively. Each station has: a photosensitive drum 30 as an image bearing member; a charging device 31 as a charging means; an LED unit 32 as an exposing means; a developing device 33 as a developing means; a primary transfer roller 35 as a transferring means; and a cleaner 36 as a cleaning means. The charging device 31 uniformly charges the peripheral surface of the photosensitive drum 30. The LED unit 32 forms an electrostatic latent image on the charged area of the peripheral surface of the photosensitive drum 30. The developing device 33 develops the electrostatic latent image on the photosensitive drum 30 into a visible image formed of toner (which hereafter may be referred to simply as toner image), with the use of toner, the particle diameter of which is in a range of 5-10 μm.

The primary transfer roller 35 transfers the toner image on the photosensitive drum 30 onto an intermediary transfer belt 34. The cleaner 36 is a cleaning means for removing the toner remaining on the peripheral surface of the photosensitive drum 30. The image forming section 3 has the intermediary transfer belt 34. The aforementioned image formation stations are aligned along the intermediary transfer belt 34. The intermediary transfer belt 34 is suspended and kept stretched by a driver roller 37, a secondary transfer inside roller 38, and a tension roller 39.

Next, the structure of the recording medium conveying section 4 is described. The recording medium conveying section 4 has a recording medium cassette 40, in which multiple sheets S of recording medium are stored. The sheets S in the cassette 40 are sequentially fed into the apparatus main assembly 1 by a feed roller 41 while being separated one by one by a pair of separation rollers 42. Then, each sheet S of recording medium is conveyed to a pair of registration rollers 44 by multiple recording medium conveyance rollers 43. As each sheet S of recording medium reaches the pair of registration rollers 44, it is delivered to the intermediary transfer belt 34 by the pair of registration roller 44 with such a timing that the sheet arrives at the secondary transfer section at the same time as the toner image on the intermediary transfer belt 34. The toner image on the intermediary transfer belt 34 is transferred onto the sheet S of recording medium by a secondary transfer roller 46, which is a transferring means. There are a conveyance belt for conveying a sheet S of recording medium, and a fixing device 47 for fixing the toner image on the sheet S to the sheet S, on the downstream side of the primary transfer roller 46. After the fixation of the toner image, the sheet S is conveyed by a pair of recording medium conveyance rollers 48 to a gloss altering apparatus 6 which is a heating apparatus.

Arriving at the gloss altering apparatus, the sheet S of recording medium is conveyed by a pair of recording medium conveyance roller 105 to the gloss altering section, in which a platen roller 101 and a thermal head (heating means) oppose each other, with the presence of the film between the platen roller 101 and thermal head 102. The thermal head 102 has a large number of heating elements which can be selectively made to generate heat according to recording information (gloss alteration information). It presses on the sheet S of recording medium with the presence of a transfer film 200 between itself and the sheet S, and heats the sheet S. That is, the heating edge of the thermal head 102 contacts the top surface (FIG. 1) of the transfer film 200, and selectively heats various areas of the sheet S, which is in contact with the other surface (bottom side) of the transfer film 200. Thus, the entirety of the toner image on the sheet S is altered in gloss, or a part or various parts of the toner image are selectively altered in gloss, whereby a watermark, a security mark, and the like pattern which are visually recognizable are effected. The transfer film 200 is controlled in tension by a tension roller 103. It is separated from the sheet S of recording medium at the location of the separation roller 104. After the gloss alteration of the sheet S (print), the sheet S is discharged into a delivery tray 49 by a pair of discharge rollers 106.

[Film Cartridge]

The aforementioned transfer film 200 is placed between the thermal head 102 and a sheet S of recording medium when heating the sheet S with the thermal head 102. Therefore, it is formed very thin and flexible. For example, it is desired that its thickness is in a range of 3-9 μm, and its thermal resistance is in a range of 1.7-2.0° C./W. It is desired to be 0.8 W/m·K in thermal conductivity, and be formed of resin. In this embodiment, it is polyethylene terephthalete film coated with parting agent. The transfer film 200 and thermal head 102 are 350 mm, for example, in width (dimension in terms of direction perpendicular to sheet conveyance direction; their length in terms of front-to-rear direction of FIG. 1), so that they can deal with a sheet of recording medium which is as large as A3 in size.

The transfer film 200 is stored in a film cartridge 2, which comprises a feed roller 202, a take-up roller 204, a feed roller container 201, and a take-up roller container 203. The feed roller 202 is the roller around which an unused roll of transfer film 200 is fitted, and from which the transfer film 200 is fed. The take-up roller 204 is a member for winding up (taking up) the used (heated) portion of the transfer film 200. In other words, one end of the transfer film 200 is attached to the feed roller 202, and the other end of the transfer film 200 is attached to the take-up roller 204. Thus, the transfer film 200 is movable between the two rollers 202 and 204 by the rotation of the two rollers 202 and 204.

Figure 2:
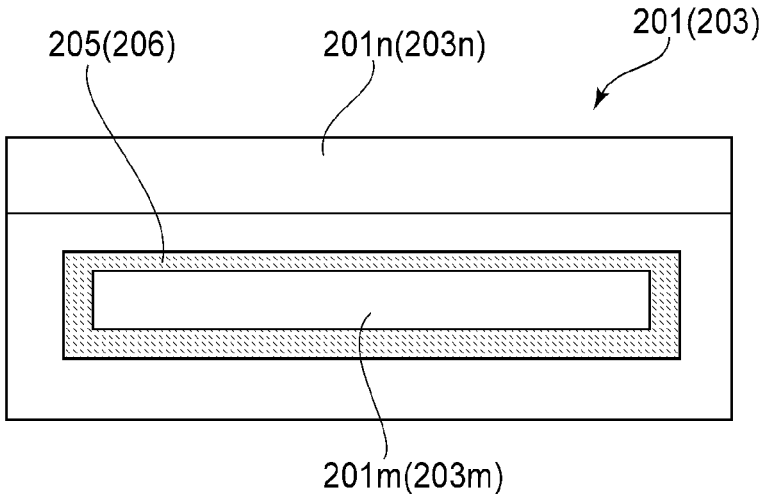
FIG. 2 is a plan view of either the take-up roller container or the feed roller container, as seen from the direction of the other container.
Figure 3:
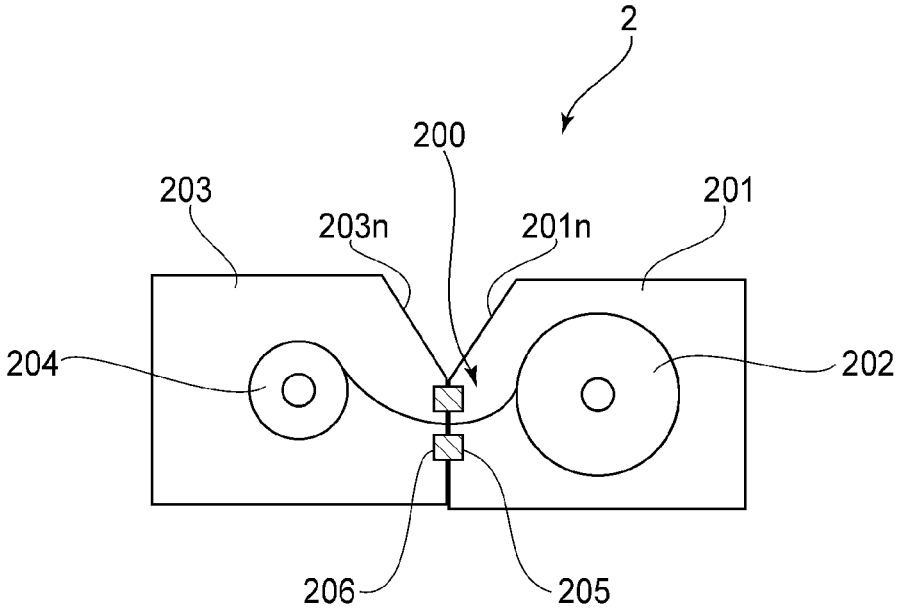
FIG. 3 is a schematic sectional view of the film cartridge, in the first embodiment of the present invention, the take-up roller container and feed roller container of which are in contact with each other as they are when a film cartridge is brand-new, and shows the general structure of the cartridge.

Next, referring to FIGS. 2 and 3, the feed roller container 201, which hereafter may be referred to as the first container, has an opening 201*m*, which hereafter may be referred to as the first opening. It contains the feed roller 202. The take-up roller container 203, which hereafter may be referred to as the second container, has an opening 203*m*, which hereafter may be referred to as the second opening. It contains the take-up roller 204. The feed roller container 201 and take-up roller containers 203 have slanted surfaces 201*n* and 203*n*, respectively, which extend diagonally downward from the top surfaces of the containers 201 and 203, respectively, and face each other. The two slanted surfaces 201*n* and 203*n* are angled so that the distance between the top edge of the surface 201*a* and the top edge of the surface 203*a* are greater than the distance between the bottom edge of the surface 201*n* and bottom edge of the surface 203*n*. The two surfaces 201*n* and 203*n* extend from the front end of the film cartridge 2 to the rear end of the film cartridge 2 (left-to-right direction in FIG. 2; front-to-back direction in FIG. 3). Incidentally, a term "widthwise direction" in this specification and its claim section of the present invention means the direction perpendicular to the direction in which a sheet S of recording medium is conveyed.

Referring to FIG. 1, as the film cassette 2 is inserted into the main assembly of the gloss altering apparatus, the feed roller container 201 and take-up roller container 203 are separated from each other, and the thermal head 102 enters between the two containers 201 and 203. When heating a sheet S of recording medium (print) which is on the opposite side of the transfer film 200 from the thermal head 102, the thermal head 102 is placed in contact with the opposite side of the transfer film 200 from the sheet S, between the opening 201*m* of the feed roller container 201 and the opening of the take-up roller container 203. The transfer film 200 is fed from the feed roller 202 through the opening 201*m* of the feed roller container 201, and is taken up (wound up) by the take-up roller 204 through the opening 203*m* of the take-up roller container 203.

The film cartridge 2 structured as described above is removably installable in the gloss altering apparatus 6. When it is not in the gloss altering apparatus, its feed roller container 201 and take-up roller container 203 kept united with each other, as shown in FIG. 3, in such a manner that at least one surface of the transfer film 200 is covered with the feed roller container 201 and/or take-up roller container 203. Incidentally, in the case of the film cartridge 2 shown in FIG. 3, the entirety of the transfer film 200 is covered with the two containers 201 and 203, being thereby prevented from being exposed. However, the opposite surface of the transfer film 200 from the covered surface of the transfer film 200 may remain exposed through an opening which a part of the feed roller container 201 may be provided, and/or an opening which a part of the take-up roller container 203 may be provided.

Further, when the film cartridge 2 is remaining properly positioned in the gloss altering apparatus 6, the feed roller container 201 and take-up roller container 203 remain separated from each other as described above, and therefore, the transfer film 200 remains exposed between the opening 201*m* of the feed roller container 201 and the opening 203*m* of the take-up roller container 203, enabling thereby the thermal head 102 to heat the preselected portion or portions of a sheet S of recording medium through the transfer film 200, as described above.

To describe more concretely, referring to FIG. 2, the feed roller container 201 and take-up roller container 203 are provided with openings 201*m* and 203*m*, respectively, which are positioned so that when the two containers 201 and 203 are remaining united with each other as shown in FIG. 3, the openings 201*m* and 203*m* align with each other. The edges of at least one of the opening 201*m* of the feed roller container 201 and the opening 203*m* of the take-up roller container 203 is provided with an elastic member 205 (or 206). Further, when the feed roller container 201 and take-up roller container 203 is remaining united with each other as shown in FIG. 3, the elastic member 205 (and/or elastic member 206) is kept elastically pressed upon the edges of the opening of the other container, sealing thereby between the two containers 201 and 203.

In the case of the film cassette 2 shown in FIG. 3, the elastic members 205 and 206 are positioned so that they surround the opening 201*m* of the feed roller container 201 and the opening 203*m* of the take-up roller container 203, respectively, and also, so that when the two containers 201 and 203 are remaining united with each other as shown in FIG. 3, the two elastic members 205 and 206 remain in contact with each other. However, it may be only one of the two openings 201*m* and 203*m* that is surrounded by an elastic member (it is not mandatory that the other opening also is surrounded by elastic member), so that when the two containers 201 and 203 are remaining united with each other as shown in FIG. 3, the elastic member attached to surround one of the two openings 201*m* and 203*m* directly contacts the edges of the other opening. Since the film cassette 2 is provided with the elastic member 205 and/or elastic member 206, which are positioned as described above, it is ensured that foreign substances such as dust are prevented from invading into the containers when the film cartridge 2 is carried around before it is installed in the gloss altering apparatus. The elastic members 205 and 206 are desired to be capable of airtightly sealing between the two containers 201 and 203, and therefore, are desired to be formed of polyurethane or the like substance.

Figure 4:
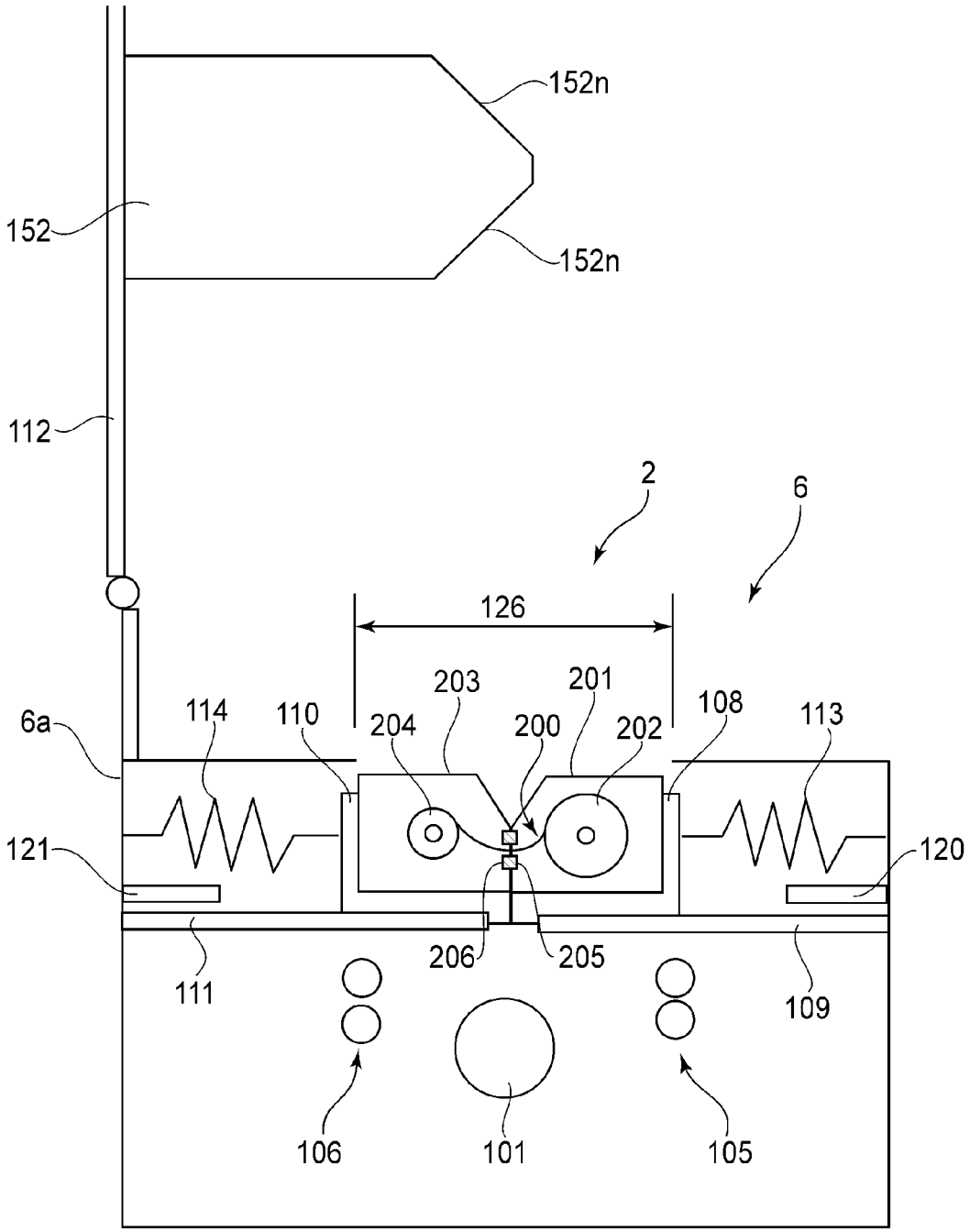
FIG. 4 is a schematic sectional view of the gloss altering apparatus and the film cartridge therein right after the complete insertion of the film cartridge into the gloss altering apparatus, and shows the general structure of the combination of the gloss altering apparatus and the film cartridge therein.

Next, referring to FIG. 4, the film cartridge 2 is installed into the gloss altering apparatus while its two contains 201 and 203 are kept united with each other as shown in FIG. 3. More concretely, the procedure for installing the film cartridge 2 into the gloss altering apparatus is as follows: First, the top lid 112 of the gloss altering apparatus is to be opened. As the lid 112 is opened, an opening 126 for allowing the film cartridge 2 to be installed into, or removed from, the gloss altering apparatus, is exposed. Next, the film cartridge 2 is to be inserted into the gloss altering apparatus through the opening 126, while the feed roller container 201 and take-up roller container 203 of the film cartridge 2 are kept united with each other, in such a manner that the feed roller container 201 and take-up roller container 203 settle on the cartridge holders 108 and 110 of the gloss altering apparatus, respectively.

As for the size of the opening 126 for inserting or removing the film cartridge 2, it is required to be minimum for insertion or removal of the film cartridge 2. This restriction is for preventing, as much as possible, foreign substances such as dust from entering the gloss altering apparatus. The cartridge holders 108 and 110 are on a pair of rails 109 and 111, being therefore movable in the left-to-right (or right-to-left) direction of FIG. 4 along the rails.

The film cartridge 2 is provided with a pair of springs 113 and 114. The spring 113 is between the cartridge holder 108 and the frame 6*a* (stationary) of the gloss altering apparatus, whereas the spring 114 is between the cartridge holder 110 and the frame 6*a* (stationary) of the gloss altering apparatus. Thus, the springs 113 and 114 keep the cartridge holder 108 and 110 pressured toward the holders 110 and 108, respectively. This setup is for reuniting the feed roller container 201 and take-up roller container 203 (which are kept separated while they are in gloss altering apparatus) when replacing the film cartridge 2 in the gloss altering apparatus. The springs 113 and 114 are desired to be the same in coefficient of springiness, but may be different.

Figure 5:
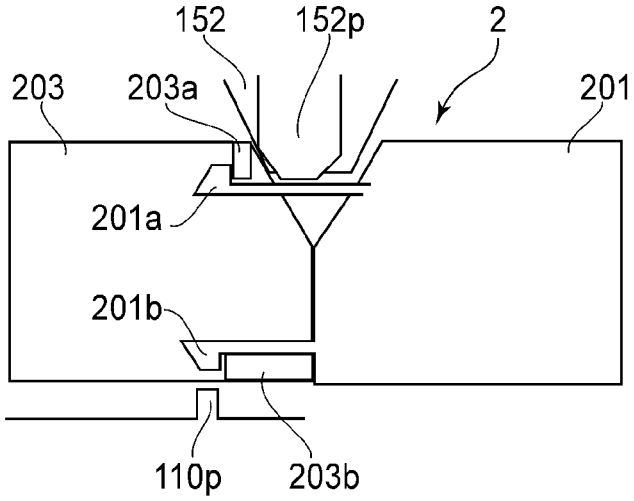
FIG. 5 is a plan view of the film cartridge (as seen from its lengthwise direction), which is in the gloss altering apparatus, and the take-up roller container and feed roller container of which are in connection to each other as they are when the film cartridge is brand-new.

The feed roller container 201 and take-up roller container 203 of the film cartridge 2 need to be kept united while the film cartridge 2 is out of the gloss altering apparatus as described above. Therefore, one of the two containers 201 and 203 is provided with a pair of elastic hooks, which are at one of the lengthwise ends of each container, one for one, whereas the other container is provided with a pair of projections, which are at the lengthwise ends of the container, and with which the elastic hooks can engage, one for one, to keep the two containers 201 and 203 united as shown in FIG. 5. The hook can be disengaged from the projection by being elastically bent away from the projection. In this embodiment, the pair of elastic hooks and pair of projections make up the means for keeping the feed roller container 201 and take-up roller container 203 united.

More concretely, in the case of the film cartridge 2 shown in FIG. 5, each of the lengthwise ends of its feed roller container 201 is provided with a pair of hooks 201*a* and 201*b*, which extend in the direction of the take-up roller container 203 from the top and bottom portions, respectively, of one of the lengthwise wall of the feed roller container 201. Further, each of the lengthwise end walls of the take-up roller container 203 is provided with a pair of projections 203*a* and 203*b*, which perpendicularly project outward of the take-up roller container 203 from the top and bottom portions, respectively, of the lengthwise end wall. Thus, the feed roller container 201 and take-up roller container 203 are kept united by the engagement between the hooks 201*a* and 201*b* and the projections 203*a* and 203*b*, respectively. Therefore, it does not occur that the distance between the feed roller container 201 and take-up roller container 203 will change while the film cartridge 2 is carried around by a user, for example.

On the other hand, the cartridge holder 110, on which the take-up roller container 203 of the gloss altering apparatus is mounted is provided with a projection, which is on the top surface of the holder 110. Further, the lid 112 is provided with a pair of plates 152, which are at the lengthwise ends of the lid 112, one for one. Each plate 152 perpendicularly projects from the corresponding lengthwise end of the inward surface of the lid 112. In terms of the widthwise direction of the lid 112, each plate 152 is located so that when the lid 112 is remaining closed, the plate 152 is between the feed roller container 201 and take-up roller container 203. Further, each plate 152 is provided with a pin 152*p*, which projects from the outward surface of the plate 152 in such a direction that when the lid 112 is in the closed state, the pin 152*p* projects downward. Further, the opposite end portion of each plate 152 from the lid 112 is shaped so that the farther from the lid 112 (in terms of direction in which plate 152 intrudes between feed roller container 201 and take-up roller container 203), the narrower the plate 152; it has a pair of slanted edges 152*n*.

As the film cartridge 2 is installed into the gloss altering apparatus, with its feed roller container 201 and take-up roller container 203 remaining united, as shown in FIG. 4, the pin 110*p* comes into contact with the bottom hook 201*b*, and elastically bends the hook 201*b* in such a manner that the end portion of the hook 201*b* moves upward. Thus, the hook 201*b* becomes disengaged from the projection 203*b*. Further, while the lid 112 is closed, the pin 152*p* comes into contact with the top hook 201*a* and elastically bends the hook 201*a* in such a manner that the end portion of the hook 201*a* moves downward. Thus, the hook 201*a* becomes disengaged from the projection 203*a*.

Incidentally, in a case where the feed roller container 201 is provided with a projection 201*a*, and the take-up roller container 203 is provided with a hook 203*a*, the cartridge holder 108 is provided with the bottom pin 110*p*. Further, the top and bottom sides of the film cartridge 2 may be different in terms of which of the two containers 201 and 203 is provided with a hook, or a projection. Moreover, the hooks, projections, pins, and holders are located at the lengthwise ends (front and rear ends when film cartridge 2 is in gloss altering apparatus), and therefore, they do not come into contact with the transfer film 200. In other words, they are outside the path of the transfer film 200 in terms of the widthwise direction of the transfer film 200.

In order to install the film cartridge 2 into the gloss altering apparatus, the film cartridge 2 is to be inserted into the gloss altering apparatus so that the take-up roller container 203 is placed on the holder 110 as described above. As the film cartridge 2 is inserted into the gloss altering apparatus as described above, the pin 110*p* pushes the hook 201*b* upward, whereby the bottom side of the feed roller container 201 becomes disengaged from the bottom side of the take-up roller container 203. Next, the lid 112 of the gloss altering apparatus is to be closed. As the lid 112 is closed, the plate 152 enters the gap between the slanted surface 201*n* of the feed roller container 201 and the slanted surface 203*n* of the take-up roller container 203. That is, the gloss altering apparatus is structured so that the plate 152 can enter between the feed roller container 201 and take-up roller container 203. As the plate 152 enters between the two containers 201 and 203, the pin 152*p* presses the hook 201*a* downward, whereby the top portion of the feed roller container 201 becomes disengaged from the top portion 203*a* of the take-up roller container 203. In other words, in this embodiment, the pins 110*p* and 152*p* make up a means for disengaging the feed roller container 201 and take-up roller container 203 from each other.

Figure 6:
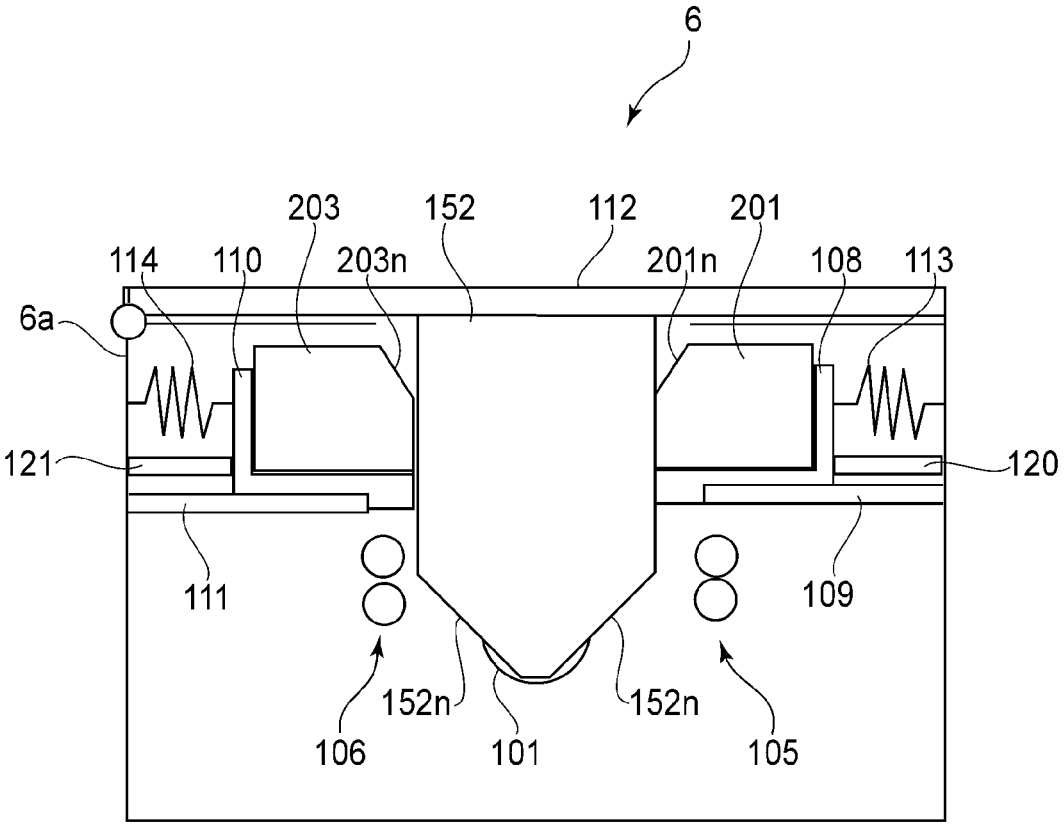
FIG. 6 is a plan view of the film cartridge (as seen from its lengthwise direction), which is in the gloss altering apparatus, and the take-up roller container and feed roller container of which are in separation from each other by a preset distance.
Figure 7:
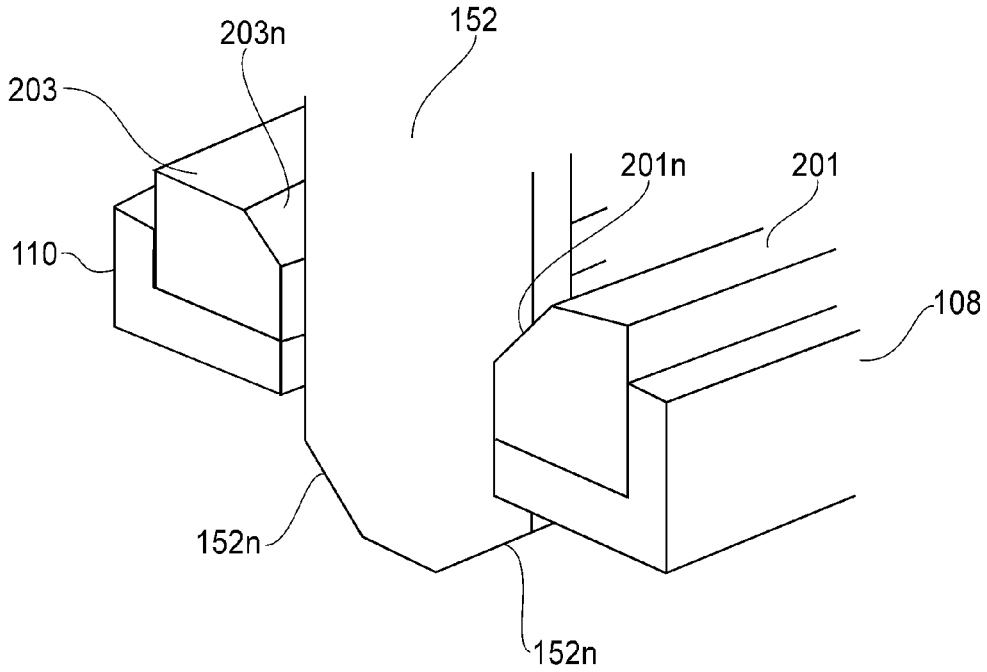
FIG. 7 is a schematic perspective view of one of the lengthwise end portions of the film cartridge (certain portions of which are not shown).

That is, as the lid 112 is closed, the feed roller container 201 and take-up roller container 203, shown in FIG. 5, are disengaged from each other, whereby it becomes possible for the distance between the feed roller container 201 and take-up roller container 203 to be changed. As the plate 152 is moved further downward (forward in terms of entering direction), the pair of diagonal edges 152*n* of the plate 152 come into contact with the slanted surfaces 201*n* and 203*n*, respectively, of the cartridge 2 while the plate 152 enters between the two containers 201 and 203. As the plate 152 moves further downward, it forces the feed roller container 201 and take-up roller container 203 to move away from each other as shown in FIGS. 6 and 7. After forcing the feed roller container 201 and take-up roller container 203 to move away from each other, the plate 152 remains between the two containers 201 and 203. In other words, in this embodiment, the plate 152 makes up a means for separating and keeping separated the feed roller container 201 and take-up roller container 203 from each other.

Figure 8:
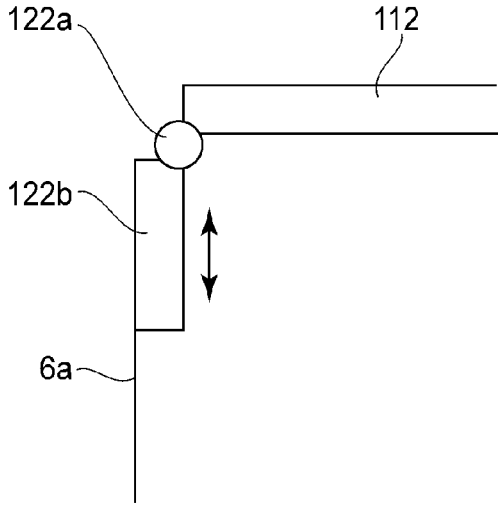
FIG. 8 is a schematic sectional view of the joint between the main frame and lid of the gloss altering apparatus, and shows the general structure of the joint.

Next, referring to FIG. 8, the lid 112 provided with the plate 152 is in connection to the frame 6*a* of the gloss altering apparatus in such a manner that the lid 112 can be moved upward or downward. More concretely, the lid 112 is in connection to the frame 6*a* of the gloss altering apparatus with the presence of a hinge 122*a* and a rail 122*b* between the lid 112 and frame 6*a*. The first step to be taken in order to close the lid 112 when the lid 112 is open as shown in FIG. 4 is to rotate the lid 112 about the hinge 112*a* so that the lid 112 becomes horizontal. The second step is to move the lid 112 downward along the rail 122*b*.

As the lid 112 is closed as described above, the center portion of the plate 152 enters between the feed roller container 201 and take-up roller container 203, and causes the cartridge holder 108 and 110 to come into contact with a pair of bumpers 120 and 121, respectively, fixed to the frame 6*a* of the gloss altering apparatus. As a result, the feed roller container 201 and take-up roller container 203 are precisely positioned relative to the frame 6*a* of the gloss altering apparatus, being thereby readied for its usage as shown in FIG. 6. When the film cartridge 2 is in the state shown in FIG. 6, the transfer film 200 remains exposed between the feed roller container 201 and take-up roller container 203.

As described above, the film cartridge 2 can be changed in the distance between the feed roller container 201 and take-up roller container 203; the distance between the feed roller container 201 and take-up container 203 before the film cartridge 2 is readied for its usage is smaller than that when the film cartridge 2 is ready for its usage. Therefore, the amount of space which the film cartridge 2 requires when it is carried around and/or stored outside the gloss altering apparatus is substantially smaller than when it is used.

Figure 9:
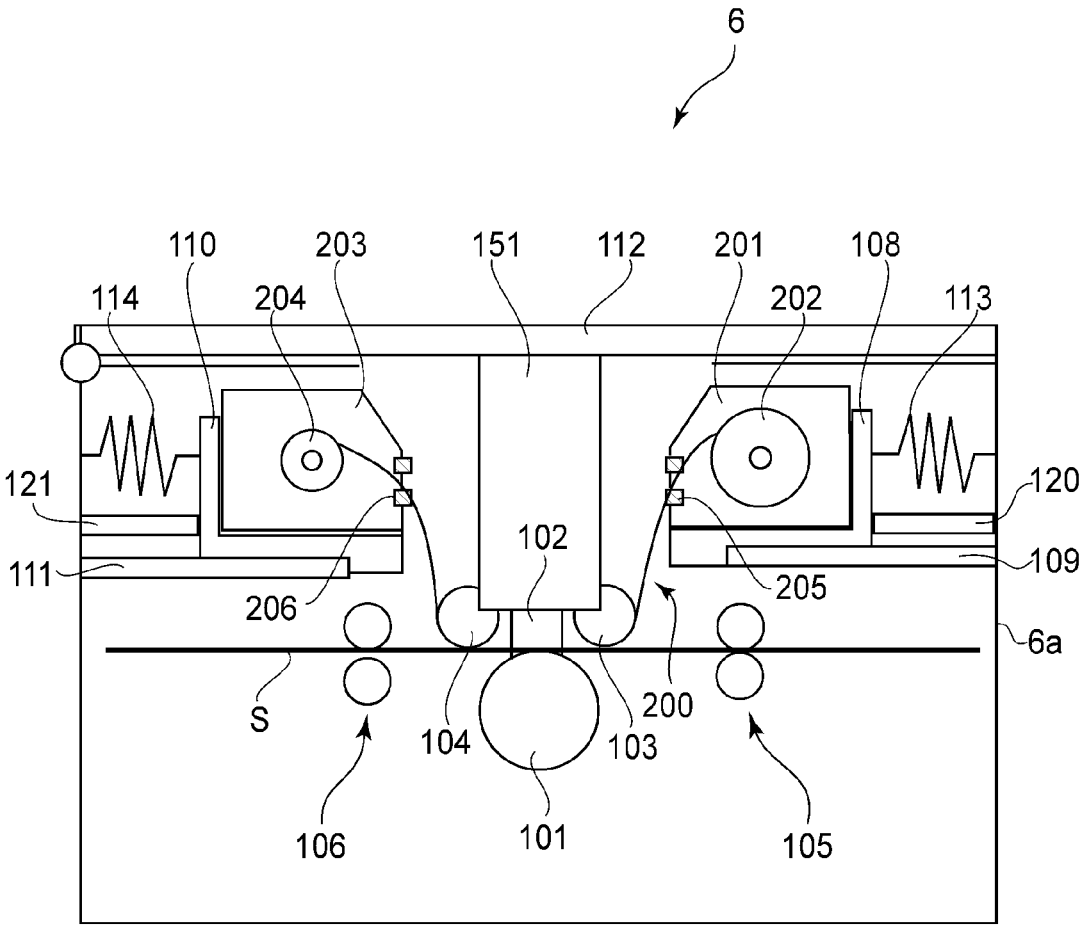
FIG. 9 is a schematic sectional view of the gloss altering apparatus in use, at a plane which is parallel to the moving direction of the film and coincides with the center of the film cartridge in the apparatus in terms of the widthwise direction of the film.

Next, referring to FIG. 9, while the feed roller container 201 and take-up roller container 203 remain separated from each other by a preset distance as described above, the thermal head 102, tension roller 103, and separation roller 104, which are on the head support frame 151, are between the two containers 201 and 203. The head support frame 151 is on the inward surface of the lid 112, and is positioned so that when the lid 112 is remaining closed, it is between the feed roller container 201 and take-up roller container 203. Further, in terms of the lengthwise direction of the gloss altering apparatus, the head support frame 151 is between the pair of plates 152 which are at the lengthwise ends of the lid 112, one for one.

The thermal head 102 is fixed to the opposite end of the head support frame 151 from the lid 112. The tension roller 103 and separation roller 104 are rotatably supported by the head support frame 151, by their lengthwise ends, and are on the upstream and downstream sides of the thermal head 102, respectively, in terms of the recording medium conveyance direction. Therefore, as the lid 112 is closed, the thermal head 102, tension roller 103, and separation roller 104 come into contact with the portion of the transfer film 200, which has just become exposed because of the separation of the feed roller container 201 and 203 from each other as described above.

Then, as the lid 112 is moved downward, the thermal head 102, tension roller 103, and separation roller 104 press on the transfer film 200, placing thereby the transfer film 200 in the preset position while tensioning the transfer film 200 and pulling the transfer film 200 out of the feed roller container 201. That is, the transfer film 200 is kept stretched by the tension roller 103 and separation roller 104, the thermal head 102 comes into contact with the portion of the transfer film 200, which is between the two rollers 103 and 104. When the gloss altering apparatus is in the above described state, the thermal head 102 opposes the platen roller 101 with the presence of the transfer film 200 between the thermal head 102 and platen roller 101.

Figure 10:
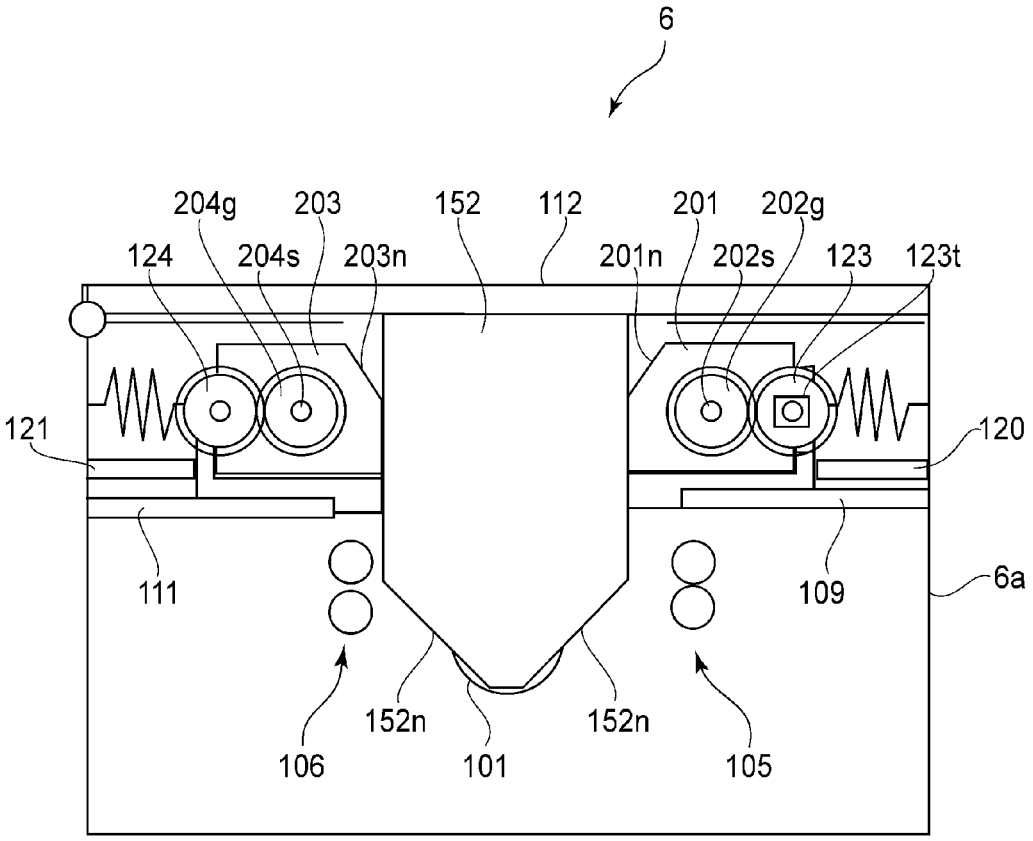
FIG. 10 is a combination of FIG. 6 and the components for driving the gloss altering apparatus.

FIG. 10 is a schematic sectional view of the gloss altering apparatus when the gloss altering apparatus is in operation. It shows the structure of the gloss altering apparatus, in particular, the components which drive the gloss altering apparatus. The feed roller 202 and take-up roller 204 are supported by shafts 202*s* and 204*s*, respectively, which are rotatably supported by the feed roller container 201 and take-up roller container 203, respectively. One of the lengthwise ends of the feed roller 202 is solidly fitted with a gear 202*g*, and the corresponding lengthwise ends of the take-up roller 204 is solidly fitted with a gear 204*g*. Further, the gloss altering apparatus is provided with a pair of gears 123 and 124, which are in connection to a torque limiter 123*t* and a motor (unshown), respectively.

When the film cartridge 2 is installed into the gloss altering apparatus, the feed roller container 201 and take-up roller container 203 are separated from each other by the plate 152 as described above. As for the gears 202*g* and 204*g*, as the lid 112 is closed, they are moved toward the gears 123 and 124, respectively, and as the gloss altering apparatus becomes ready for usage, the gears 202*g* and 204*g* mesh with the gears 123 and 124, respectively as shown in FIG. 10, being thereby enabled to transmit torque to the feed roller 202 and take-up roller 204, respectively. Therefore, while the gloss altering apparatus is in use, the feed roller 202 is provided with a preset amount of load by the torque limiter 123*t*, being thereby reliably controlled in rotation, whereas the take-up roller 204 is provided with torque from the motor, being enabled to take up the transfer film 200.

Incidentally, in the embodiment described above, the film cartridge 2 and gloss altering apparatus are structured so that as the lid 112 is closed, both the feed roller container 201 and take-up roller container 203 are made to move in the direction to separate from each other. However, the structural arrangement for separating the two containers 201 and 203 from each other does not need to be limited to the one in this embodiment. That is, the structural arrangement may be such that only one of the containers 201 and 203 is moved while the other is kept stationary. For example, the take-up roller container 203 may be immovably attached to the frame 6*a* of the gloss altering apparatus in such a manner that when the film cartridge 2 is installed into the gloss altering apparatus, the driving force for taking up the transfer film 200 can be transmitted to the take-up roller 204. That is, the gear 204*g* of the take-up roller 204 is engaged with the gear 124 which is in connection to the motor. Thus, the feed roller container 201 is moved to make the feed roller container 201 and take-up roller container 203 separate from each other. This setup ensures that the take-up roller 204 is connected to, and driven by, the motor.

Figure 11:
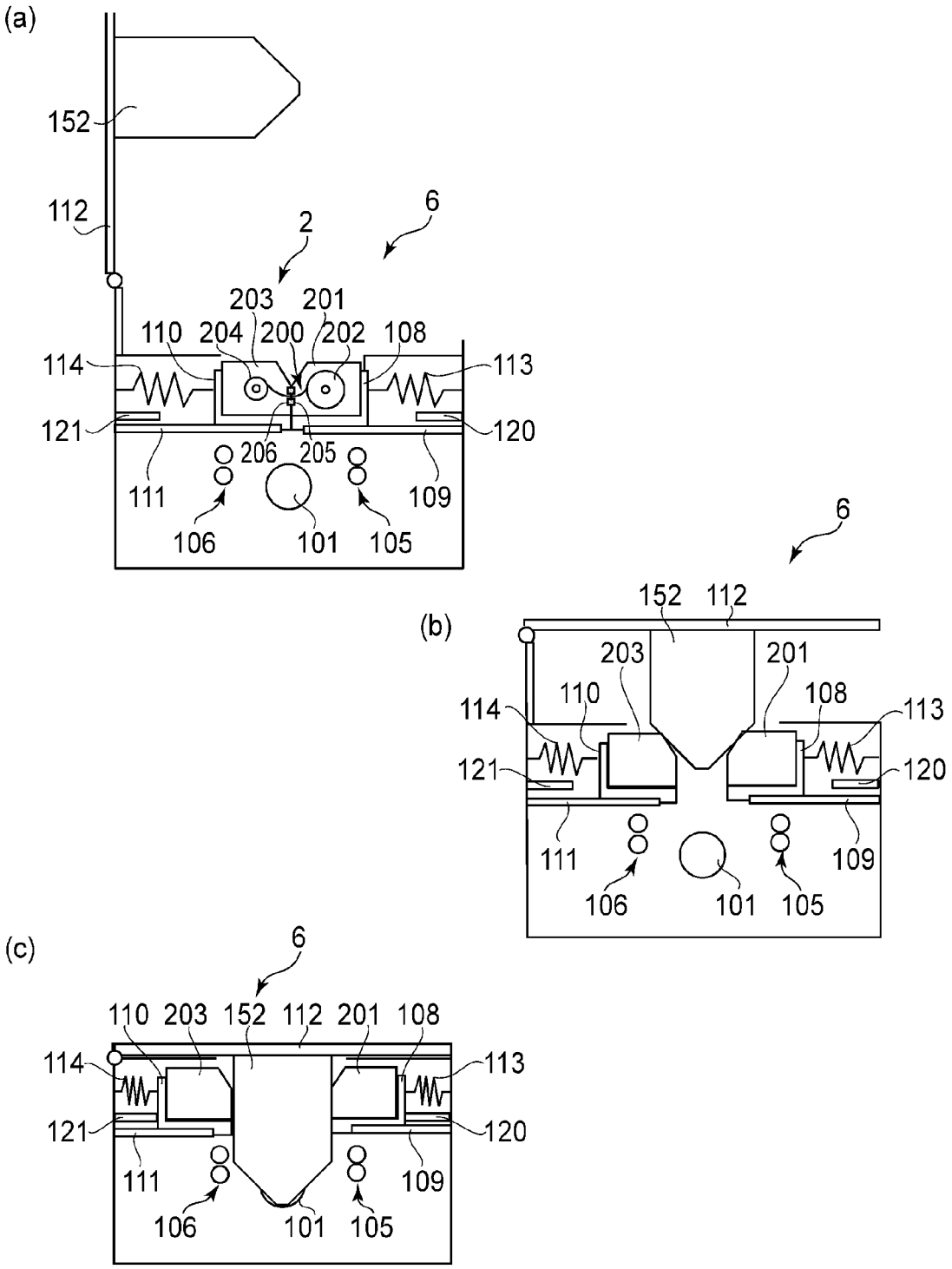
FIGS. 11(*a*), 11(*b*) and 11(*c*) are schematic sectional views of the gloss altering apparatus, as seen from the lengthwise direction of the apparatus, and sequentially show how the film cartridge is readied for usage after the installation of the cartridge into the apparatus.

FIGS. 11(*a*), 11(*b*) and 11(*c*) are schematic drawings of the front side (rear side is symmetrical to front side) of the gloss altering apparatus, and shows the structure of the front side of the gloss altering apparatus. They sequentially show how the film cartridge 2 is readied for usage after its insertion into the gloss altering apparatus. FIG. 11(*a*) shows the state of the combination of the film cartridge 2 and gloss altering apparatus immediately after the film cartridge 2 was inserted into the gloss altering apparatus. FIG. 11(*b*) shows the state of the combination while the feed roller container 201 and take-up roller container 203 are being separated from each other by the downward movement of the lid 112 for separating the two containers 201 and 203. FIG. 11(*c*) show the state of the combination while the gloss altering apparatus (film cartridge 2) is used.

Next, how the film cartridge 2 is taken out of the gloss altering apparatus is described. When it is necessary to take the film cartridge 2 out of the gloss altering apparatus, the lid 112 is to be moved upward following in reverse the steps followed when the film cartridge 2 was installed into the gloss altering apparatus. That is, the sequence for taking the film cartridge 2 out of the gloss altering apparatus is a reversal of the sequence for installing the film cartridge 2, and therefore, it progresses in the order of FIGS. 11(*c*), 11(*b*) and 11(*a*).

Figure 12:
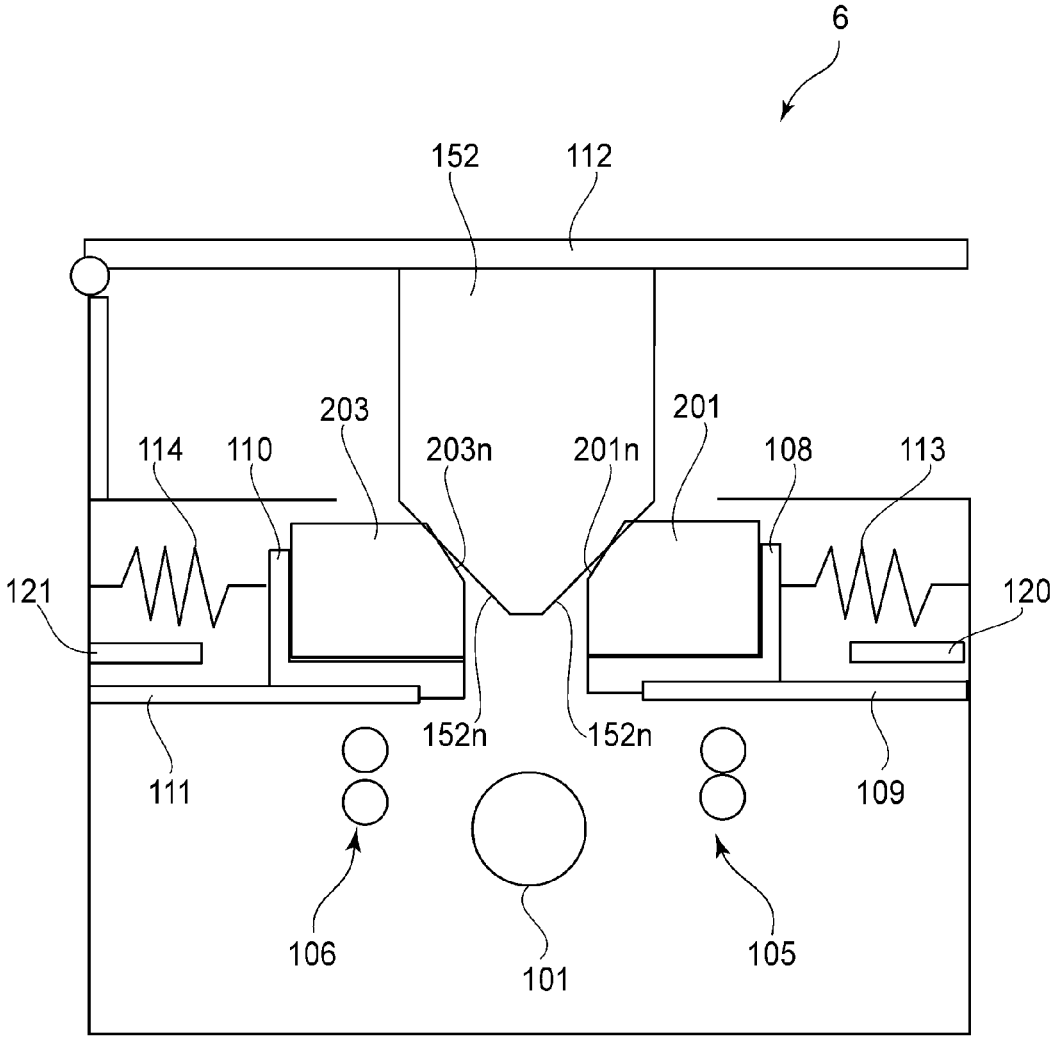
FIG. 12 is a schematic drawing of the gloss altering apparatus, as seen from the lengthwise direction of the film cartridge, while the film cartridge is uninstalled from the apparatus.

As the plate 152 is moved upward with the lid 112, the pair of diagonal edges 152*n*, which make up the opposite ends of the plate 152 from the lid 112, come into contact with the slanted surface of the feed roller container 201 and the slanted surface of the take-up roller container 203. The feed roller container 201 and take-up roller container 203 are under the pressure generated in the direction to press the feed roller container 201 and take-up roller container 203 toward each other, by the combination of the compression spring 113 which is between the cartridge holder 108 and frame 6*a*, and the compression spring 114 which is between the cartridge holder 110 and frame 6*a*. Therefore, as the lid 112 is moved upward with the plate 152, the cartridge holder 108 and 110 gradually approach each other, with the slanted surfaces 201*n* and 203*n* sliding on the diagonal edges 152*n*, one for one, as shown in FIG. 12.

Then, as the lid 112 is opened (rotated upward about hinge 122*a*), the state of the gloss altering apparatus changes into the one shown in FIG. 4, that is, the state in which the feed roller container 201 and take-up roller container 203 are united with each other, allowing thereby the film cartridge 2 to be taken out of the gloss altering apparatus. As the state of the gloss altering apparatus changes into the one shown in FIG. 4, the hooks 201*a* and 201*b* engage with the projections 203*a* and 203*b*, respectively, preventing thereby the feed roller container 201 and take-up roller container 203 from separating from each other.

Incidentally, the gloss altering apparatus may be structured so that the film cartridge 2 can be installed into, or removed from, the gloss altering apparatus in the following manner. That is, when the film cartridge 2 is removed, the feed roller 202, which is the upstream roller in terms of the recording medium conveyance direction, is to be rotated, whereas when the film cartridge 2 is installed, the take-up roller 204, which is the downstream roller, is to be rotated. More concretely, each of the feed roller 202 and take-up roller 204 is provided with its own motor, which is rotated during the installation or removal of the film cartridge 2. Another example of the structural arrangement is to position a driving force transmitting mechanism between the gears 123 and 124, and the lid 112 so that each of the feed roller 202 and take-up roller 204 is rotated by the opening or closing movement of the lid 112.

The reason why the downstream roller is to be rotated during the installation of the film cartridge 2 is that even if a small amount of dust or the like has adhered to the unrolled portion of the transfer film 200, rotating the downstream roller can prevent the dust or the like on the unrolled portion of the transfer film 200 from adhering to the thermal head 102. The reason why the gloss altering apparatus is structured so that when removing the film cartridge 2, the upstream roller is rotated is that rotating only the downstream roller increases the gloss altering apparatus in film consumption. Obviously, if it is a greater concern to prevent dust or the like from adhering to the thermal head 102 than to reduce the gloss altering apparatus in film consumption, the downstream roller may be rotated even when removing the film cartridge 2.

In this embodiment, when the film cartridge 2 is out of the gloss altering apparatus, the transfer film 200 remains covered by the feed roller container 201 and take-up roller container 203. Therefore, it is unlikely for foreign substance from adhering to the transfer film 200 when the film cartridge 2 is out of the gloss altering apparatus. That is, when the film cartridge 2 is out of the gloss altering apparatus, its feed roller container 201 and take-up roller container 203 remain united with each other as shown in FIG. 3 so that the transfer film 200 is not exposed. That is, while the film cartridge 2 is carried around, installed into the gloss altering apparatus, or removed from the gloss altering apparatus, the transfer film 200 remains within the film cartridge 2. Therefore, it is unlikely for foreign substances such as dust to adhere to the transfer film 200, and therefore, it is unlikely for the thermal head 102 to be prevented by the foreign substances such as dust from properly heating a sheet of recording medium and the image thereon.

Further, when the film cartridge 2 is out of the gloss altering apparatus, its feed roller container 201 and take-up roller container 203 remain united with each other. Therefore, it is unnecessary for a user to use both hands to handle the film cartridge 2; the film cartridge 2 can be easily handled with a single hand. In other words, the film cartridge 2 in this embodiment is easy to handle or carry around.

Further, it is after the installation of the film cartridge 2 into the gloss altering apparatus that the feed roller container 201 and take-up roller container 203 are separated from each other to expose the transfer film 200. Therefore, it is unlikely that foreign substances will adhere to the transfer film 200 while the film cartridge 2 is installed into, or uninstalled from, the gloss altering apparatus. That is, immediately after the installation of the film cartridge 2 into the gloss altering apparatus, the transfer film 200 is yet to be exposed as shown in FIG. 4. Then, as the lid 112 is closed, the feed roller container 201 and take-up roller container 203 are separated from each other to expose the transfer film 200 as shown in FIGS. 5-7. As for the uninstallation of the film cartridge 2, as the lid 112 is opened, the feed roller container 201 and take-up roller container 203 are united to cover the transfer film 200 as shown in FIG. 12. Therefore, the combination of the gloss altering apparatus and film cartridge 2 in this embodiment can minimize the opportunity for foreign substances to adhere to the transfer film 200, while being structured so that the film cartridge 2 is removably installable in the gloss altering apparatus.

Further, this embodiment makes it possible for the feed roller container 201 and take-up roller container 203 to be separated from each other, or united, by the opening or closing movement of the lid 112, being therefore excellent in terms of operational efficiency. Moreover, this embodiment prevents foreign substances from adhering to the transfer film 200. Therefore, this embodiment makes it unnecessary for the thermal head 102 to be a part of the film cartridge 2. Therefore, the film cartridge 2 in this embodiment is significantly less in cost than any film cartridge (2) in accordance of the prior art.

By the way, as long as the surface of the transfer film 200, which comes into contact with the thermal head 102, remains covered with the feed roller container 201 and take-up roller container 203, it is unlikely to occur that the adhesion of foreign substances to the transfer film 200 will cause the gloss altering apparatus to improperly heat a sheet of recording medium and the image thereon. To describe in more detail, if the opposite surface of the transfer film 200 from the thermal head 102 remains exposed even when the feed roller container 201 and take-up roller container 203 remain united, foreign substances adhere to this surface of the transfer film 200. Thus, it is possible that as the film cartridge 2 is installed into the gloss altering apparatus while separating the feed roller container 201 and take-up roller container 203 from each other, the platen roller 101, for example, will come into contact with this surface, making it possible for the foreign substances on the transfer film 200 to adhere to the platen roller 101.

However, the platen roller 101 is one of the components that come into contact with recording medium. Thus, even if foreign substances adhere to the platen roller 101, the foreign substances on the platen roller 101 hardly affect the performance of the thermal head 102 (gloss altering apparatus) when the thermal head 102 (gloss altering apparatus) is heating a sheet of recording medium and the image thereon. Therefore, all that is necessary is the surface of the transfer film 200, which faces the thermal head 102, remains covered when the film cartridge 2 is out of the gloss altering apparatus.

In this embodiment, the combination of the gloss altering apparatus and the film cartridge 2 therefor is structured as described above. Therefore, when the film cartridge 2 is out of the gloss altering apparatus, at least the surface of the transfer film 200, which comes into contact with the heating means, remains covered by the first and second containers. Therefore, it is unlikely for foreign substances to adhere to the surface of the transfer film 200, which comes into contact with the heating means. Further, the transfer film 200 is exposed by separating the first and second containers from each other after the insertion of the film cartridge 2 into the gloss altering apparatus. Therefore, it is unlikely for foreign substances to adhere to the transfer film 200 while the film cartridge 2 is installed into, or uninstalled from, the gloss altering apparatus. Further, the heating means does not need to be integrated into the film cartridge 2. Therefore, the film cartridge 2 in this embodiment is significantly lower in cost than any film cartridge (2) in accordance with the prior art.

Embodiment 2

Figure 13:
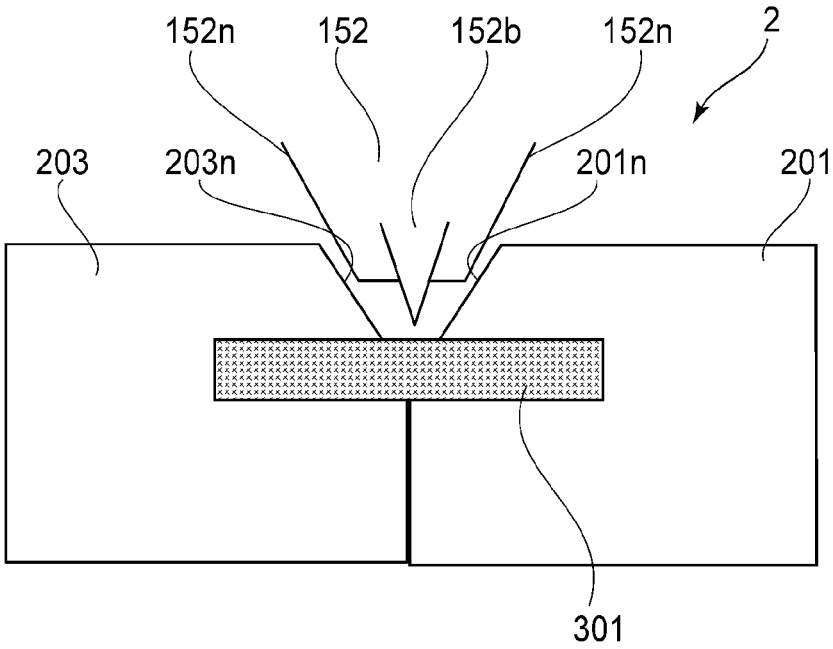
FIG. 13 is a plan view of a combination of the film cartridge, and the film slicing blade, in the second embodiment of the present invention, as seen from the lengthwise direction of the cartridge, immediately before the take-up roller container and feed roller container of the cartridge are separated from each other.

Next, referring to FIG. 13, the second embodiment of the present invention is described. In this embodiment, the feed roller container 201 and take-up roller container 203 are kept united with the use of a piece of adhesive tape 301, which is a means for keeping the two containers 201 and 203 united. The tape 301 is pasted to both of the lengthwise ends of the film cartridge 2, being pasted to both containers 201 and 203 to keep the two containers 201 and 203 united. Further, the gloss altering apparatus is provided with a pair of blades 152*b*, which are attached to the pair of plates 152 which are at the lengthwise ends of the gloss altering apparatus, one for one. Each blade 152*b* projects from the opposite end of the plate 152 from the lid 112. In other words, the gloss altering apparatus in this embodiment is provided with the pair of blades 152*b* instead of the pair of pins 152*p* with which the gloss altering apparatus in the first embodiment was provided.

The blade 152*b* is a means for giving the tape 301 a small cut for ripping the tap 301, by being placed in contact with the tape 301. As the lid 112 is closed to ready the gloss altering apparatus after the insertion of the film cartridge 2 into the gloss altering apparatus, the blade 152*b* is moved downward together with the plate 152, by the movement of the lid 112, slightly cutting the tape 301. As the lid 112 is closed further, the plate 152 enters between the feed roller container 201 and take-up roller container 203, separating thereby the two containers 201 and 203 from each other while following the slanted surface 201*n* of the feed roller container 201 and the slanted surface 203*n* of the take-up roller container 203. Thus, the tape 301 is cut by the combination of the blade 152*b* and the force generated by the downward movement of the plate 152 in the direction to separate the two containers 201 and 203. Consequently, the film cartridge 2 becomes ready for usage as shown in FIG. 6.

Incidentally, the tape 301 may be peeled away by a user. In a case where the tape 301 is to be peeled away by a user, the blade 152*b* is unnecessary. The operational sequence for taking the film cartridge 2 in this embodiment out of the gloss altering apparatus is the same as that for taking the film cartridge 2 in the first embodiment out of the gloss altering apparatus. That is, the feed roller container 201 and take-up roller container 203 are made to approach to each other, and united, in the order shown in FIGS. 11(*c*), 11(*b*) and 11(*a*). In this case, a user is to paste a fresh piece of tape 301 to the united feed roller container 201 and take-up roller container 203, as shown in FIG. 13, before the user takes the film cartridge 2 out of the gloss altering apparatus.

Using the tape 301 as it is used in this embodiment makes unnecessary the hooks 201*a* and 201*b*, projections 203*a* and 203*b*, and pins 152*p* and 110*p*, which are the members for keeping the two containers 201 and 203 united with each other, or separating the two containers 201 and 203 from each other. Therefore, the combination of the gloss altering apparatus and film cartridge 2 in this embodiment is lower in cost than the combination of the feed roller container 201 and take-up roller container 203 in this first embodiment. The structural arrangement for the gloss altering apparatus and film cartridge 2 in this embodiment other than the above described ones, and the operational steps in this embodiment other than the above described ones, are the same as those in the first embodiment.

Embodiment 3

Figure 14:
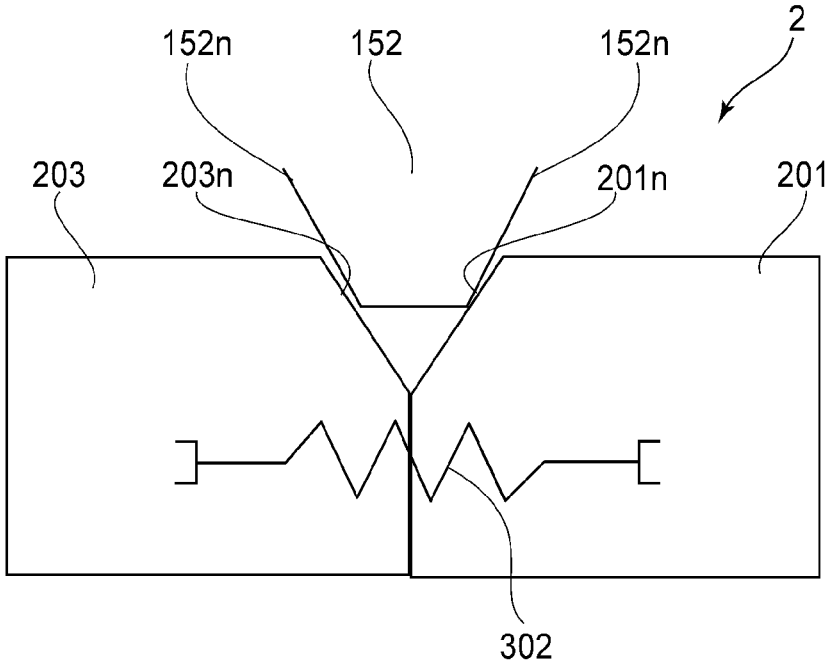
FIG. 14 is a schematic plan view of a combination of the film cartridge and separation plate 152 in the third embodiment of the present invention, as seen from the lengthwise direction of the cartridge, immediately before the take-up roller container and feed roller container of the cartridge are separated from each other.

Next, referring to FIG. 14, the third embodiment of the present invention is described. In this embodiment, the feed roller container 201 and take-up roller container 203 are kept united by a pair of tensional springs 302, which are pressure applying means. One end of each spring 302 is in connection to the feed roller container 201, and the other is in connection to the take-up roller container 203. Thus, the feed roller container 201 and take-up roller container 203 remain under the tensional force which pulls the two containers 201 and 203 toward each other. That is, the spring 302 keeps the feed roller container 201 and take-up roller container 203 pressured toward each other. The pair of springs 302 are attached to the lengthwise ends of the film cartridge 2, one for one, and keep the two containers 201 and 203 bound to each other by the lengthwise ends of the two containers.

After the insertion of the film cartridge 2 into the gloss altering apparatus, the lid 112 is to be moved downward to ready the gloss altering apparatus. As the lid 112 is moved downward, the movement of the lid 112 causes the plates 152 to intrude between the feed roller container 201 and take-up roller container 203, following the slanted surface 201*n* of the feed roller container 201 and the slanted surface 203*n* of the take-up roller container 203. Consequently, the feed roller container 201 and take-up roller container 203 are separated from each other, being thereby readied for usage as shown in FIG. 6.

The operational sequence for taking the film cartridge 2 out of the gloss altering apparatus is the same as the one in the first embodiment. That is, the feed roller container 201 and take-up roller container 203 are made to approach each other as shown in FIGS. 11(*c*), 11(*b*) and 11(*a*), by the resiliency of the springs 302, until the feed roller container 201 and take-up roller container 203 are united as shown in FIG. 14. It is after the feed roller container 201 and take-up roller container 203 are united that the film cartridge 2 is to be taken out of the gloss altering apparatus.

In this embodiment, the feed roller container 201 and take-up roller container 203 are kept pressured toward each other by the pair of tensional springs 302. Therefore, such springs as the springs 113 and 114 shown in FIG. 1 are unnecessary, nor are the components, portions, etc., such as the hooks 201*a*, 201*b*, projections 203*a* and 203*b*, and pins 152*p* and 110*p*, which are the means for keeping the two containers 201 and 203 united, or separating the two containers 201 and 203 from each other. Therefore, the film cartridge 2 in this embodiment is substantially lower in cost than any film cartridge 2 in accordance with the prior art. The other structural arrangement and operational sequence for the combination of the film cartridge 2 and gloss altering apparatus, other than those described above, are the same as those in the first embodiment.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 127091/2011 filed Jun. 7, 2011 which is hereby incorporated by reference.

What is claimed is:

1. A film cartridge detachably mountable to a gloss processing apparatus, said film cartridge comprising:

a film configured to gloss at least part of a toner image on a sheet;

a first roller configured so that said film can be wound thereon;

a first container configured to contain said first roller, said first container having a first opening configured to permit passage of said film therethrough;

a second roller configured to wind up said film; a second container configured to contain said second roller, said second container having a second opening configured to permit passage of said film therethrough;

a hooked portion provided in either one of said first container and said second container;

a hooking portion provided in the other one of said first container and said second container and configured to engage said hooked portion to (i) close said first opening by said second container and (ii) close said second opening by said first container, wherein said hooking portion is elastically deformable to permit release of engagement with said hooked portion.

2. A film cartridge detachably mountable to a gloss processing apparatus, said film cartridge comprising:

a film configured to gloss at least part of a toner image on a sheet;

a first roller configured so that said film can be wound thereon;

a first container configured to contain said first roller, said first container having a first opening configured to permit passage of said film therethrough;

a second roller configured to wind said film up;

a second container configured to contain said second roller, said second container having a second opening configured to permit passage of said film therethrough; and an urging portion configured to urge said first container and said second container toward each other to (i) close said first opening by said second container and (ii) close said second opening by said first container.

3. A gloss processing apparatus for glossing at least part of a toner image formed on a sheet, said apparatus comprising:

(i) a main body of said apparatus including a movable portion;

(ii) a film cartridge detachably mountable to said main body, said film cartridge including (ii-i) a film;

(ii-ii) a first roller configured so that said film can be wound thereon;

(ii-iii) a first container configured to contain said first roller, said first container having a first opening configured to permit passage of said film therethrough;

(ii-iv) a second roller configured to wind up said film;

(ii-v) a second container configured to contain said second roller, said second container having a second opening configured to permit passage of said film therethrough; and (ii-vi) an abutting portion configured to abut said movable portion with a moving operation to receive a force for causing said first container and said second container to move away from each other.

4. A gloss processing apparatus according to claim 3, wherein said movable portion includes a heater, including a plurality of heating elements arranged along a direction substantially perpendicular to a sheet conveying direction, configured to heat the toner image on the sheet through said film, and wherein said heater contacts said film with movement of said first container and said second container away from each other.

5. A gloss processing apparatus according to claim 4, wherein said main body includes a pressing roller configured to press said film toward said heater.

6. A gloss processing apparatus according to claim 3, wherein said main body includes a closing mechanism configured to (i) close said first opening by said second container and (ii) close said second opening by said first container, with a movement of said movable portion away from said abutting portion.

7. A gloss processing apparatus according to claim 6, wherein said closing mechanism includes a first urging portion configured to urge said first container toward said second container and a second urging portion configured to urge said second container toward said first container.

8. A gloss processing apparatus according to claim 3, wherein said movable portion includes a tapered portion at an end which is abutted to said abutting portion.

9. A gloss processing apparatus according to claim 3, wherein said abutting portion includes a tapered portion at an end which is abutted to said movable portion.

10. A gloss processing apparatus according to claim 3, wherein said film cartridge includes:

a hooked portion provided in either one of said first container and said second container; and a hooking portion provided in the other one of said first container and said second container and configured to engage with said hooked portion to (i) close said first opening by said second container and (ii) close said second opening by said first container, wherein said hooking portion is elastically deformable to permit release of an engagement with said hooked portion with a mounting operation of said film cartridge to said main body.

11. A gloss processing apparatus according to claim 10, wherein said main body includes a force applying portion configured to apply a force for elastically deforming said hooking portion to permit the release of the engagement with the mounting operation of said film cartridge.

12. A gloss processing apparatus according to claim 3, wherein said film cartridge includes a urging portion configured to urge said first container and said second container toward each other to (i) close said first opening by said second container and (ii) close said second opening by said first container.

13. A gloss processing apparatus according to claim 3, wherein said film cartridge includes a connecting tape configured to connect said first container and said second container to (i) close said first opening by said second container and (ii) close said second opening by said first container.

14. A gloss processing apparatus according to claim 13, wherein said movable portion includes a cutting portion configured to cut said connecting tape with the moving operation of said movable portion to permit movement of said first container and said second container away from each other.

* * * * *